US012410796B2

(12) United States Patent
Tanahashi et al.

(10) Patent No.: US 12,410,796 B2
(45) Date of Patent: Sep. 9, 2025

(54) SCROLL COMPRESSOR

(71) Applicant: MITSUBISHI HEAVY INDUSTRIES THERMAL SYSTEMS, LTD., Tokyo (JP)

(72) Inventors: Ryota Tanahashi, Tokyo (JP); Goshi Iketaka, Tokyo (JP); Akinori Yoshioka, Tokyo (JP); Takayuki Kuwahara, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/834,139

(22) PCT Filed: Dec. 14, 2022

(86) PCT No.: PCT/JP2022/046082
§ 371 (c)(1),
(2) Date: Jul. 29, 2024

(87) PCT Pub. No.: WO2023/149099
PCT Pub. Date: Aug. 10, 2023

(65) Prior Publication Data

US 2025/0101983 A1 Mar. 27, 2025

(30) Foreign Application Priority Data

Feb. 3, 2022 (JP) ..... 2022-015655

(51) Int. Cl.
*F04C 18/02* (2006.01)
*F04C 27/00* (2006.01)
(Continued)

(52) U.S. Cl.
CPC ..... *F04C 29/02* (2013.01); *F04C 18/0215* (2013.01); *F04C 27/005* (2013.01); *F04C 29/028* (2013.01); *F04C 23/008* (2013.01)

(58) Field of Classification Search
CPC .... F04C 18/0215; F04C 23/008; F04C 23/02; F04C 27/005; F04C 29/02; F04C 29/023; F04C 29/026; F04C 29/028
See application file for complete search history.

(56) References Cited

U.S. PATENT DOCUMENTS 8,998,595 B2 4/2015 Ito et al.
2007/0292294 A1* 12/2007 Fujita ..... F04C 29/02 418/55.6
(Continued)

FOREIGN PATENT DOCUMENTS

JP 61076481 A * 4/1986
JP 2011-174453 A 9/2011
JP 2013-187216 A 8/2013

OTHER PUBLICATIONS

The International Search Report (PCT/ISA/210) issued in PCT/JP2022/046082, mailed on Jan. 31, 2023.
(Continued)

*Primary Examiner* — Theresa Trieu
(74) *Attorney, Agent, or Firm* — BIRCH, STEWART, KOLASCH & BIRCH, LLP

(57) ABSTRACT

Provided is a scroll compressor including: a motor configured to revolve an orbiting scroll with respect to a fixed scroll; a rotary shaft rotated about an axis by the motor; a bearing part configured to support the rotary shaft; and a housing. The housing has a partition wall part-partitioning the inner space into a first space and a second space, the motor being arranged in the first space, and the bearing part and a compressing part being arranged in the second space. The partition wall part has a first communication passage
(Continued)

and a second communication passage, the first communication passage being configured to guide a mixed refrigerant containing a lubricating oil and a refrigerant gas from the first space to a region of the second space, the bearing part being arranged in the region of the second space, and the second communication passage being configured to guide the refrigerant gas, which is contained in the mixed refrigerant guided to the region of the second space, to the compressing part.

8 Claims, 6 Drawing Sheets

(51) Int. Cl.
*F04C 29/02* (2006.01)
*F04C 23/00* (2006.01)

(56) References Cited

U.S. PATENT DOCUMENTS

2020/0080556 A1* 3/2020 Seo ..... F04C 29/0085
2020/0102956 A1 4/2020 Seong et al.

OTHER PUBLICATIONS

Extended European Search Report for European Application No. 22925003.0, dated Mar. 14, 2025.

* cited by examiner

SCROLL COMPRESSOR

TECHNICAL FIELD

The present disclosure relates to a scroll compressor.

BACKGROUND ART

Scroll compressors having a fixed scroll and an orbiting scroll engaged with the fixed scroll are conventionally known (for example, see Patent Literature 1). In Patent Literature 1, a housing on the compressor side and a housing on the electric motor side are fixed interposing a partition wall member therebetween, and thereby the housing on the compressor side and the housing on the electric motor side are separated from each other. A plurality of air inlets to communicate chambers on both sides with each other are provided in the partition wall member.

After cooling the electric motor while flowing through the housing on the electric motor side, a refrigerant gas flows into the housing on the compressor side via the air inlets of the partition wall member. The refrigerant gas that has flown into the housing on the compressor side is drawn in a variable volume chamber between the fixed scroll and the orbiting scroll, compressed into a high pressure, and discharged from the end of the housing on the compressor side. In the scroll compressor of Patent Literature 1, the refrigerant gas contains oil, and the oil turns to a mist state, which floats inside the housing and lubricates each portion inside the housing.

CITATION LIST

Patent Literature

PTL 1

Japanese Patent Application Laid-Open No. 2011-174453

SUMMARY OF INVENTION

Technical Problem

In Patent Literature 1, however, the refrigerant gas guided to the plurality of air inlets formed in the partition wall member is drawn in the variable volume chamber between the fixed scroll and the orbiting scroll without passing through the region in which a main bearing for supporting a main shaft connected to the rotary shaft of the motor, a drive bearing installed to a rear face of the orbiting scroll, or the like are arranged. Thus, the oil contained in the refrigerant gas is unable to be efficiently supplied to lubricate the main bearing or the drive bearing.

The present disclosure has been made in view of such circumstances and intends to provide a scroll compressor that can reliably guide a lubricating oil contained in a mixed refrigerant to a bearing part and reliably guide a refrigerant gas contained in the mixed refrigerant to a compressing part.

Solution to Problem

A scroll compressor according to one aspect of the present disclosure includes: a compressing part having a fixed scroll and an orbiting scroll engaged with the fixed scroll; a motor configured to revolve the orbiting scroll with respect to the fixed scroll; a rotary shaft configured to be rotated about an axis by the motor and installed to the orbiting scroll via an eccentric shaft arranged eccentrically from the axis; a bearing part configured to support the rotary shaft; and a housing formed in a cylindrical shape along the axis and having an inner space accommodating the motor and the compressing part. The housing has a partition wall part partitioning the inner space into a first space and a second space, the motor being arranged in the first space, and the bearing part and the compressing part being arranged in the second space. The partition wall part has a first communication passage and a second communication passage, the first communication passage being configured to guide a mixed refrigerant containing a lubricating oil and a refrigerant gas from the first space to a region of the second space, the bearing part being arranged in the region of the second space, and the second communication passage being configured to guide the refrigerant gas, which is contained in the mixed refrigerant guided to the region of the second space, to the compressing part.

Advantageous Effects of Invention

According to the present disclosure, it is possible to provide a scroll compressor that can reliably guide a lubricating oil contained in a mixed refrigerant to a bearing part and reliably guide a refrigerant gas contained in the mixed refrigerant to a compressing part.

DESCRIPTION OF EMBODIMENTS

Figure 1:
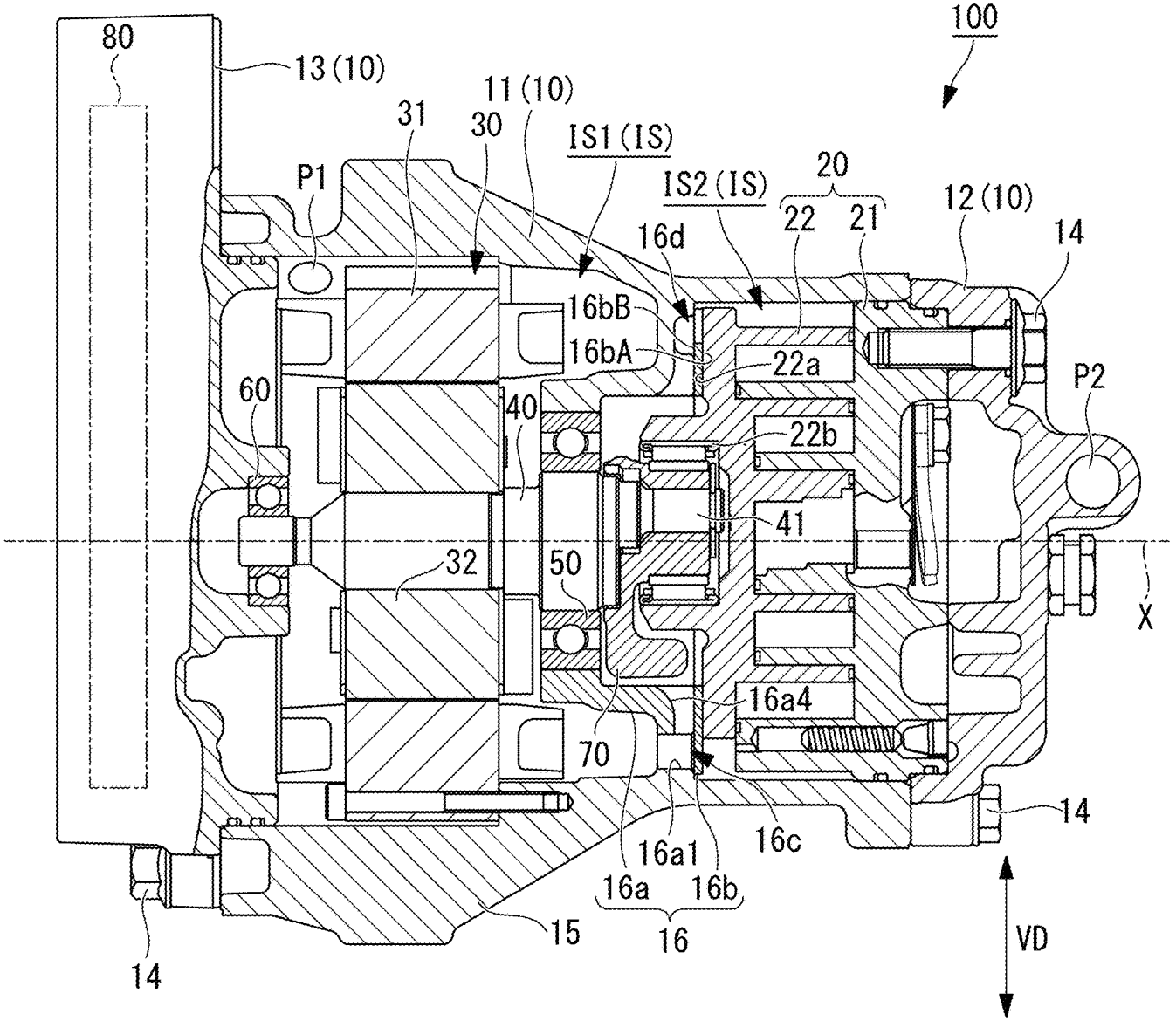
FIG. 1 is a longitudinal sectional view illustrating a general configuration of a scroll compressor according to one embodiment of the present disclosure.
Figure 2:
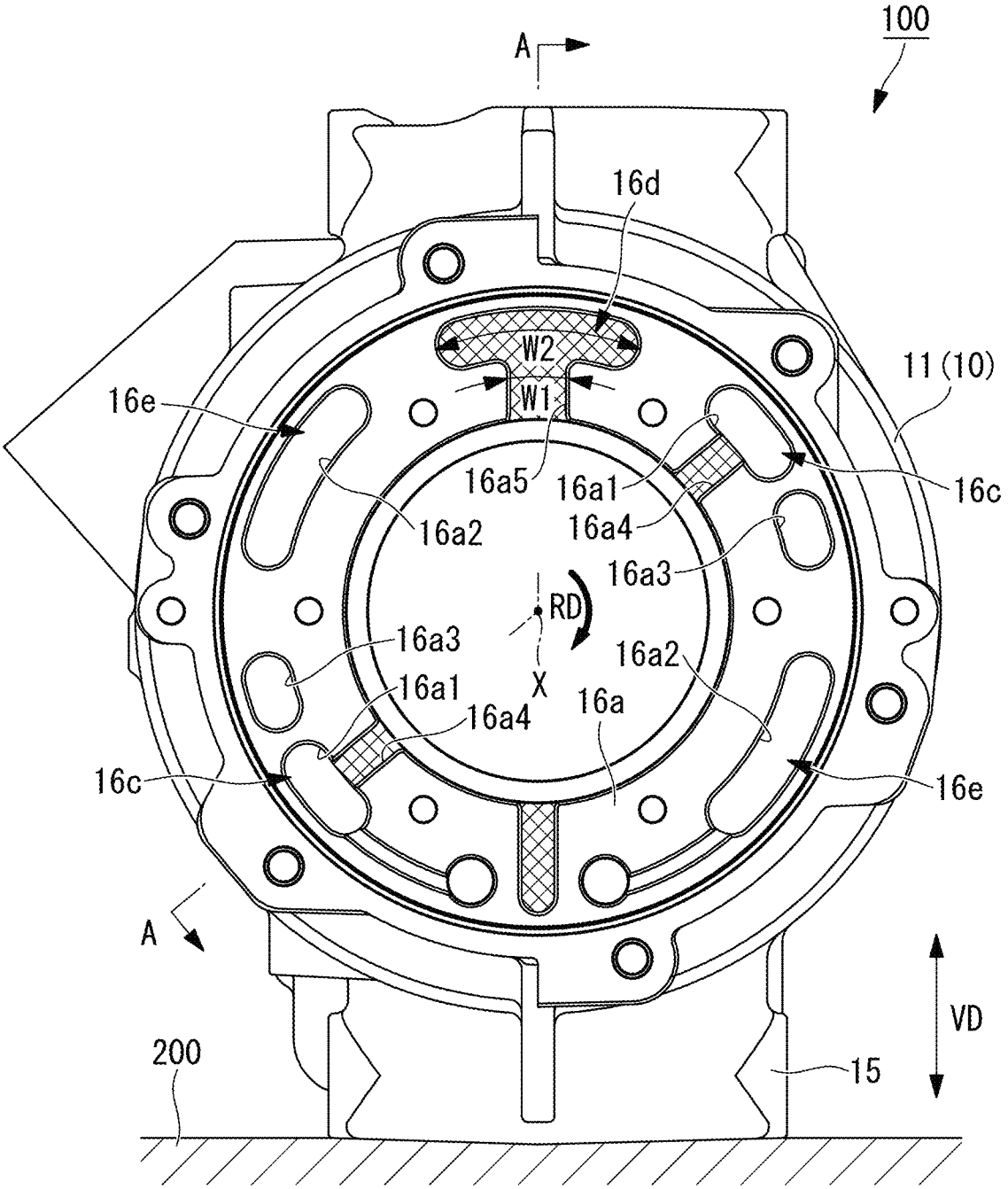
FIG. 2 is a diagram of a housing of the scroll compressor illustrated in FIG. 1 when viewed from the compressing part side.

A scroll compressor according to one embodiment of the present disclosure will be described with reference to FIG. 1 to FIG. 5. FIG. 1 is a longitudinal sectional view illustrating a general configuration of the scroll compressor according to the present embodiment. A scroll compressor 100 of the present embodiment is used for an on-vehicle air conditioner, for example. FIG. 2 is a diagram of a housing of the scroll compressor illustrated in FIG. 1 when viewed from the compressing part side. FIG. 1 is a sectional view of the scroll compressor 100 illustrated in FIG. 2 taken along the line indicated by arrows A-A. In FIG. 2, the rotation direction RD represents a rotation direction of a rotary shaft 40.

As illustrated in FIG. 1, the scroll compressor 100 has a housing 10, a compressing part 20, a motor 30, the rotary shaft 40, a bearing part 50, a bearing part 60, a balance weight 70, and an inverter 80.

The housing 10 is an outer shell of the scroll compressor 100 and is formed of an aluminum alloy. The housing 10 has a first housing 11, a second housing 12, and a third housing 13. The first housing 11, the second housing 12, and the third housing 13 are configured to be integrally fastened with bolts 14. As illustrated in FIG. 2, the housing 10 is fixed to a casing 200 via a leg 15 in a state where the axis X is arranged in the horizontal direction.

As illustrated in FIG. 1, an intake port P1 is provided on the upper side in the vertical direction (gravity direction) VD in the housing 10. The refrigerant supplied outside is introduced to an inner space IS of the housing 10 from the intake port P1. The refrigerant introduced to the housing 10 passes through the motor 30 along the axis X and is guided toward the compressing part 20. The refrigerant taken into from the intake port P1 is a mixed refrigerant containing a lubricating oil and the refrigerant gas.

The first housing 11 has the inner space IS formed in a substantially circular cylindrical shape along the axis X and accommodating the compressing part 20 and the motor 30. The second housing 12 seals one end of the first housing 11 along the axis X and is provided with a discharge port (not illustrated) for the refrigerant gas compressed by the compressing part 20. The third housing 13 seals the other end of the first housing 11 along the axis X and is provided with a space accommodating the inverter 80 inside thereof.

The housing 10 has a partition wall part 16 partitioning the inner space IS into a first space IS1 in which the motor 30 is arranged and a second space IS2 in which the bearing part 50 and the compressing part 20 are arranged. The partition wall part 16 has a bearing support part 16*a* formed integrally with the first housing 11 and a thrust plate 16*b*. The details of the partition wall part 16 will be described later.

The compressing part 20 is a device arranged inside the first housing 11 and rotated about the axis X to compress the refrigerant gas. The compressing part 20 has a fixed scroll 21 fixed in the second housing 12 and an orbiting scroll 22 engaged with the fixed scroll 21. The compressing part 20 compresses the refrigerant gas by revolving the orbiting scroll 22 with respect to the fixed scroll 21 by driving force of the motor 30.

The motor 30 is a device that revolves the orbiting scroll 22 of the compressing part 20 about the axis X with respect to the fixed scroll 21. The motor 30 has a stator 31 and a rotor 32. The rotor 32 is connected to the rotary shaft 40.

The rotary shaft 40 is a shaft-like member rotated about the axis X by the motor 30. One end of the rotary shaft 40 is supported by the bearing part 60 fixed to the third housing 13. The other end of the rotary shaft 40 is supported by the bearing part 50 fixed to the bearing support part 16*a*. An eccentric shaft 41 arranged eccentrically with respect to the axis X is provided at the end on the compressing part 20 side of the rotary shaft 40.

The eccentric shaft 41 is rotatably installed to a bearing part 22*b* fixed to the rear face of the orbiting scroll 22 via the balance weight 70. The rotary shaft 40 is installed to the orbiting scroll 22 via the eccentric shaft 41 in such a way.

The bearing part 50 is a member that is press-fitted into the bearing support part 16*a* and supports the rotary shaft 40 rotatably about the axis X.

The bearing part 60 is a member that is press-fitted into the third housing 13 and supports the rotary shaft 40 rotatably about the axis X.

The balance weight 70 is a member fixed to the eccentric shaft 41 of the rotary shaft 40 and rotated about the axis X. The balance weight 70 cancels vibrations due to revolution motion of the orbiting scroll 22.

The inverter 80 is a device that generates a drive voltage for driving the motor 30 and controls a rotation rate of the motor 30.

Next, the details of the partition wall part 16 will be described.

The bearing support part 16*a* is a member that partitions the inner space IS into the first space IS1 and the second space IS2 and into which the bearing part 50 is press-fitted. As illustrated in FIG. 2, two through-holes 16*a*1, two through-holes 16*a*2, and two through-holes 16*a*3 are formed in a face of the bearing support part 16*a* on the thrust plate 16*b* side. The through-holes 16*a*1, 16*a*2, 16*a*3 are holes to cause a face of the bearing support part 16*a* on the motor 30 side and a face on the compressing part 20 side to communicate with each other.

As illustrated in FIG. 2, grooves 16*a*4 communicating with the through-holes 16*a*1 and the second space IS2 are formed on a face of the bearing support part 16*a* on the thrust plate 16*b* side. The grooves 16*a*4 are formed at two portions so as to extend in the radial direction orthogonal to the axis X. The grooves 16*a*4 guide the mixed refrigerant guided from the through-holes 16*a*1 radially to the region in which the bearing part 50 of the second space IS2 is arranged. In FIG. 2, the grooves 16*a*4 are illustrated with hatching. The same applies to a groove 16*a*5 described later. Further, in FIG. 4 and FIG. 6, the groove 16*a*5 is also illustrated with hatching.

As illustrated in FIG. 2, the groove 16*a*5 communicating with the second space IS2 is formed on a face of the bearing support part 16*a* on the thrust plate 16*b* side. The groove 16*a*5 is formed at one portion at the upper end in the vertical direction VD of the bearing support part 16*a* so as to extend in the radial direction orthogonal to the axis X. The width of the inlet region (inner circumference side region) of the groove 16*a*5 in the rotation direction RD (the circumferential direction about the axis X) is W1. The width of the outlet region (outer circumference side region) of the groove 16*a*5 in the rotation direction RD is W2 that is larger than W1.

Figure 3:
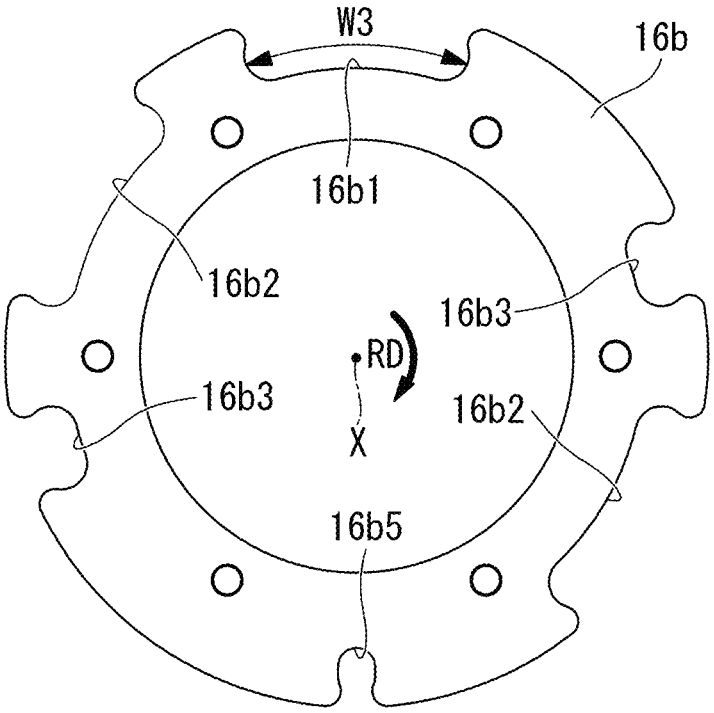
FIG. 3 is a plan view of a thrust plate illustrated in FIG. 1.

The thrust plate 16*b* is a plate-like member installed to the bearing support part 16*a* and supporting the orbiting scroll 22 by a sliding surface 16*b*A that is in contact with an end face 22*a* of the orbiting scroll 22 of the compressing part 20. FIG. 3 is a plan view of the thrust plate 16*b* illustrated in FIG. 1. As illustrated in FIG. 3, a notch 16*b*1 arranged at a position corresponding to the groove 16*a*5 formed in the bearing support part 16*a* is formed in the thrust plate 16*b*. The notch 16*b*1 has a shape that blocks the inlet region of the groove 16*a*5 while avoiding and thus not blocking the outlet region of the groove 16*a*5.

The width of the notch 16*b*1 in the rotation direction RD is W3. In the rotation direction RD, the width W1 of the inlet region of the groove 16*a*5 of the bearing support part 16*a* is smaller than the width W3 of the notch 16*b*1. The width W3 of the notch 16*b*1 substantially matches the width W2 of the outlet region of the groove 16*a*5 of the bearing support part 16*a*.

In the thrust plate 16*b*, notches 16*b*2 arranged at positions corresponding to the through-holes 16*a*2 formed in the bearing support part 16*a* are formed. The notches 16*b*2 have a shape that avoids and thus does not block the region overlapping the through-holes 16*a*2. In the rotation direction RD, the width of the notch 16*b*2 substantially matches the width of the through-hole 16*a*2 of the bearing support part 16*a*.

In the thrust plate 16*b*, notches 16*b*3 arranged at positions corresponding to the through-holes 16*a*3 formed in the bearing support part 16*a* are formed. The notches 16*b*3 have a shape that avoids and thus does not block the region overlapping the through-holes 16*a*3. In the rotation direction RD, the width of the notch 16b3 substantially matches the width of the through-hole 16a3 of the bearing support part 16a.

Figure 4:
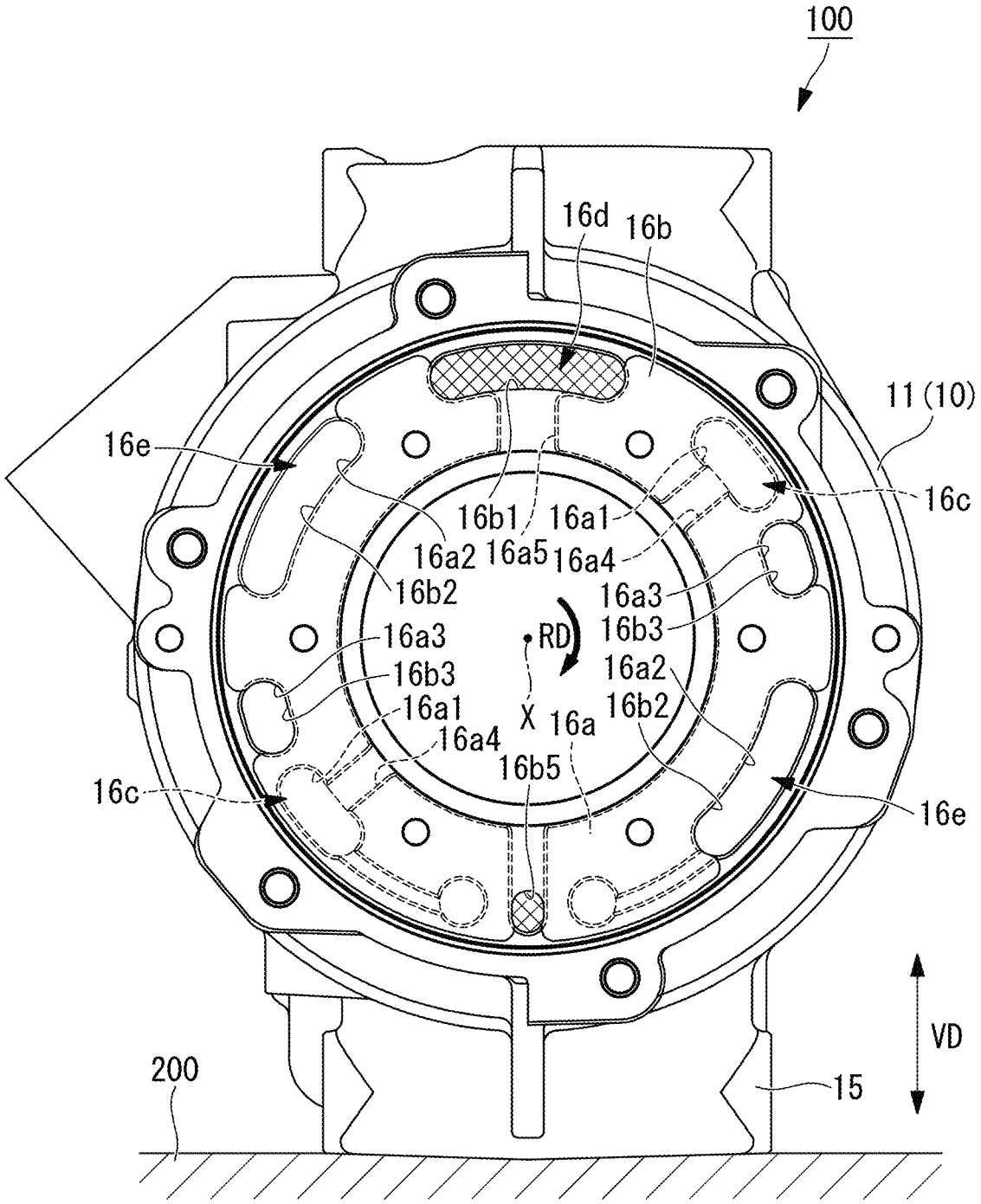
FIG. 4 is a diagram illustrating a state where the thrust plate is installed to the housing illustrated in FIG. 2.
Figure 5:
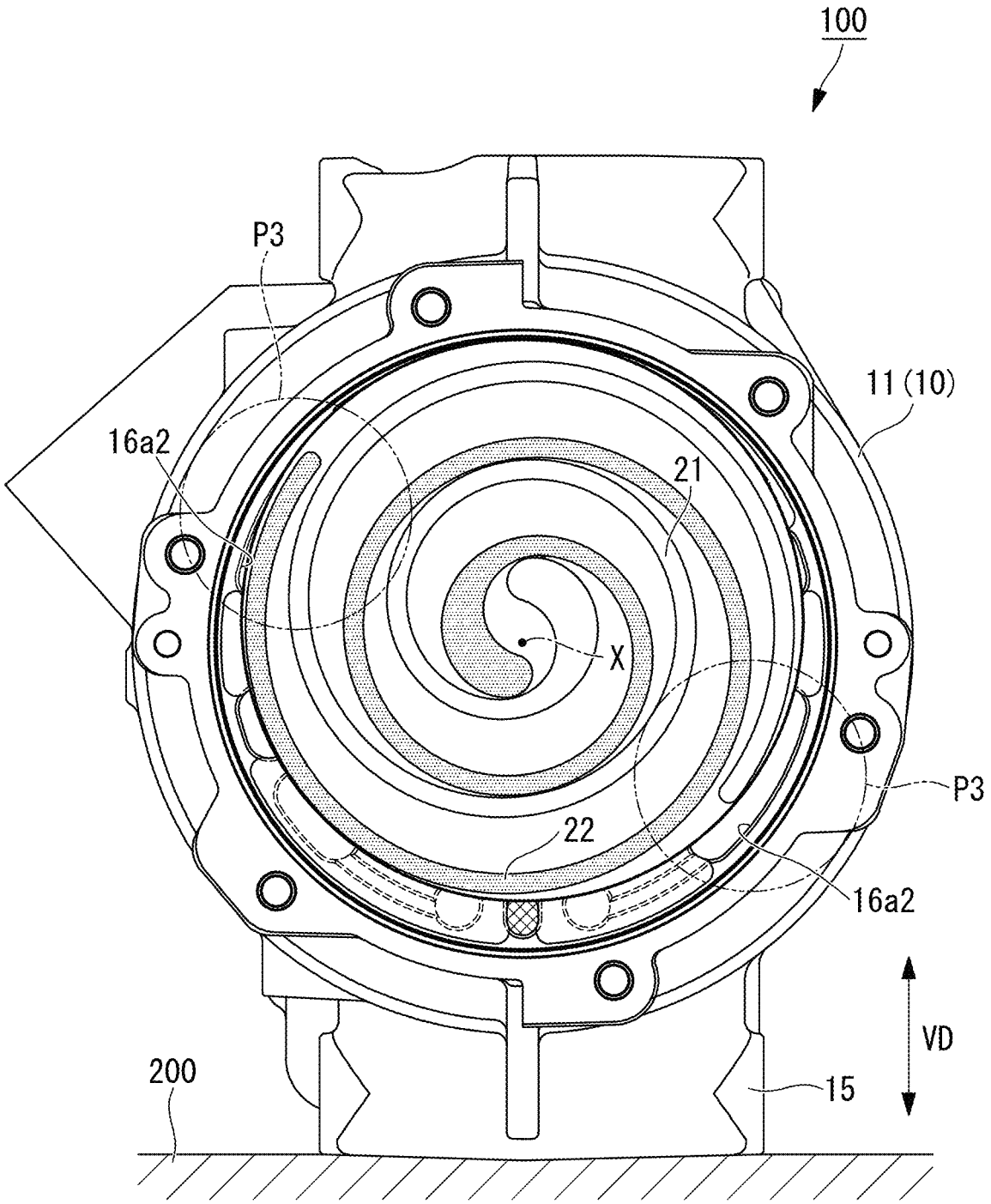
FIG. 5 is a diagram illustrating a state where the compressing part is installed to the housing illustrated in FIG. 4.

FIG. 4 is a diagram illustrating a state where the thrust plate 16b is installed to the housing 10 illustrated in FIG. 2. As illustrated in FIG. 4, the through-holes 16a1, the grooves 16a4, and the groove 16a5 formed in the bearing support part 16a are covered with a facing surface 16bB of the thrust plate 16b (see FIG. 1). The facing surface 16bB is a face that faces the face of the bearing support part 16a on the thrust plate 16b side.

The mixed refrigerant guided to the through-holes 16a1 from the first space IS1 collides with the facing surface 16bB of the thrust plate 16b and then is guided to the grooves 16a4 communicating with the through-holes 16a1. The mixed refrigerant guided to the grooves 16a4 is guided toward the axis X in the radial direction orthogonal to the axis X. The region to which the mixed refrigerant is guided is a region in which the bearing part 50 of the second space IS2 is arranged.

As discussed above, the partition wall part 16 formed of the bearing support part 16a and the thrust plate 16b has first communication passages 16c for guiding the mixed refrigerant containing a lubricating oil and a refrigerant gas from the first space IS1 to a region in which the bearing part 50 of the second space IS2 is arranged (see FIG. 1). The first communication passages 16c are formed of the through-holes 16a1, the grooves 16a4, and the facing surface 16bB of the thrust plate 16b.

The mixed refrigerant guided to the region in which the bearing part 50 of the second space IS2 is arranged flows through in the rotation direction RD, flows into the inlet region of the groove 16a5 of the bearing support part 16a, and is guided to the outlet region. The refrigerant gas guided to the outlet region of the groove 16a5 is guided via the notch 16b1 to the region in which the compressing part 20 of the second space IS2 is arranged.

As discussed above, the partition wall part 16 has a second communication passage 16d for guiding, to the compressing part 20, a refrigerant gas contained in the mixed refrigerant guided to a region in which the bearing part 50 of the second space IS2 is arranged (see FIG. 1). The second communication passage 16d is formed of the groove 16a5, the facing surface 16bB of the thrust plate 16b, and the notch 16b1.

The mixed refrigerant guided from the first space IS1 to the through-holes 16a2 is guided from the first space IS1 to intake positions P3 of the compressing part 20 of the second space IS2 without passing through the region in which the bearing part 50 is arranged. This is because the notches 16b2 are formed at positions corresponding to the through-holes 16a2 of the thrust plate 16b. The intake position P3 is an end (winding end) of the fixed scroll 21. Further, the intake position P3 is an end (winding end) of the orbiting scroll 22.

As discussed above, the partition wall part 16 has third communication passages 16e configured to guide the refrigerant gas from the first space IS1 to the compressing part 20 of the second space IS2 without causing the refrigerant gas to pass through the region in which the bearing part 50 is arranged. The third communication passage 16e guides the refrigerant gas to the intake position P3 in which the end of the fixed scroll 21 or the end of the orbiting scroll 22 is arranged.

The mixed refrigerant guided from the first space IS1 to the through-holes 16a3 is guided from the first space IS1 to the compressing part 20 of the second space IS2 without passing through the region in which the bearing part 50 is arranged. This is because the notches 16b3 are formed at positions corresponding to the through-holes 16a3 of the thrust plate 16b.

A notch (oil returning part) 16b5 for returning the lubricating oil (not illustrated) that remains below the housing 10 in the vertical direction VD from the sliding surface 16bA side to the facing surface 16bB side is formed in the thrust plate 16b. As illustrated in FIG. 4, the second communication passage 16d is formed on the opposite side of the notch 16b5 with respect to the axis X. The second communication passage 16d is formed at a position away from the notch 16b5 in the circumferential direction about the axis X in an angular range of 90 degrees or more and 270 degrees or less. By forming the second communication passage 16d on the opposite side of the notch 16b5 with respect to the axis X, it is possible to suppress the lubricating oil from being guided to the second communication passage 16d.

In the example illustrated in FIG. 4, the first communication passages 16c are arranged at two portions, one of which is at about 135 degrees away from the position at which the second communication passage 16d is arranged in the opposite direction of the rotation direction RD, and the other of which is at about 315 degrees away from the position at which the second communication passage 16d is arranged. In such a case, in the rotation direction RD, the positions at which the first communication passages 16c are arranged and the position at which the second communication passage 16d is arranged are away from each other by about 135 degrees or more.

Figure 6:
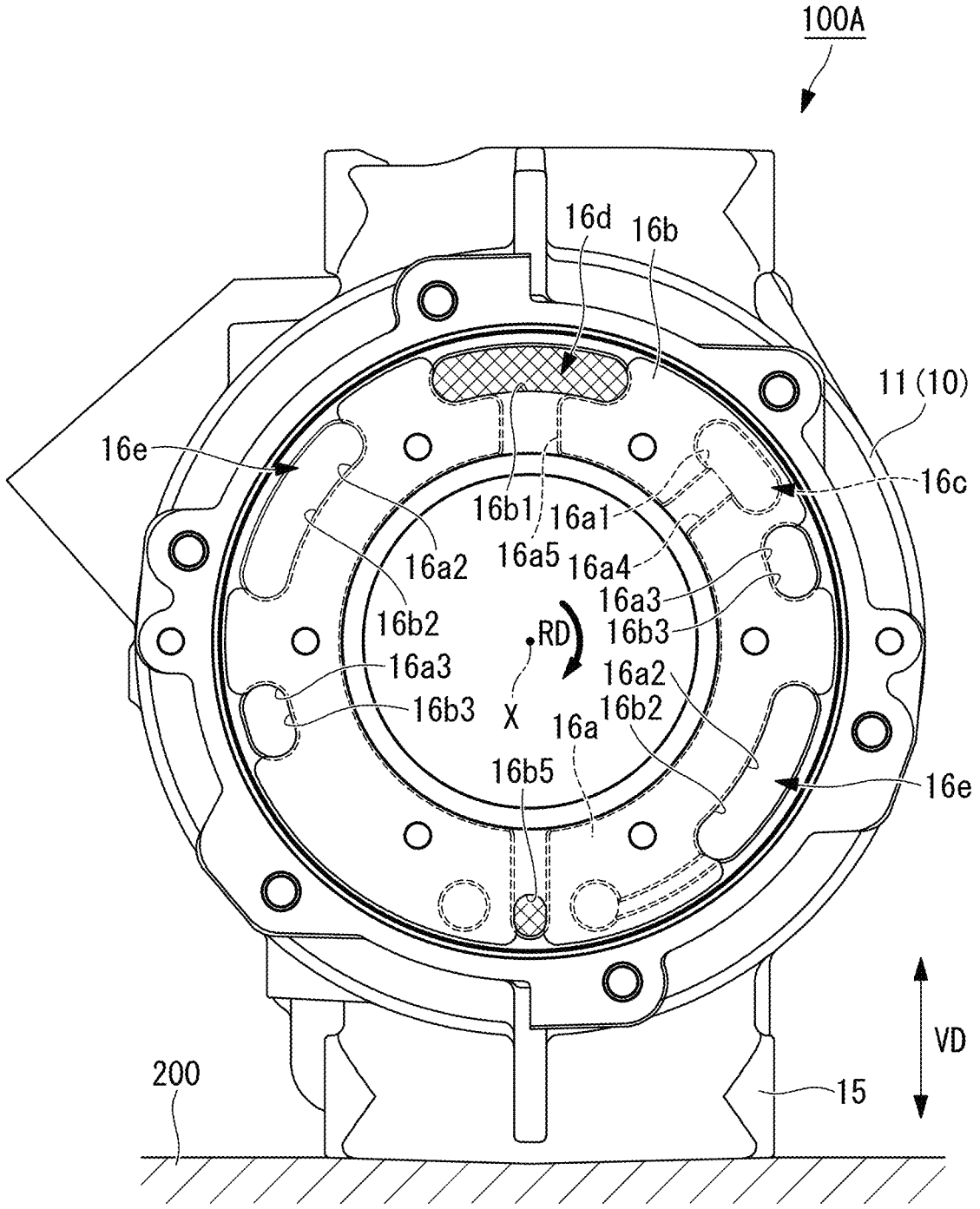
FIG. 6 is a diagram of a housing of a scroll compressor of a modified example when viewed from the compressing part side.

The example illustrated in FIG. 4 may be changed to other modified examples. For example, in the rotation direction RD, the position at which the first communication passage 16c is arranged and the position at which the second communication passage 16d is arranged may be away from each other by 180 degrees or more. FIG. 6 is a diagram of the housing 10 of a scroll compressor 100A in the modified example when viewed from the compressing part 20 side. In FIG. 6, the first communication passage 16c is arranged at only one portion, which is at about 315 degrees away from the position at which the second communication passage 16d is arranged in the opposite direction of the rotation direction RD. In such a case, in the rotation direction RD, the position at which the first communication passage 16c is arranged and the position at which the second communication passage 16d is arranged are away from each other by about 315 degrees.

In the rotation direction RD, when the position at which the first communication passage 16c is arranged and the position at which the second communication passage 16d is arranged are more away from each other, the lubricating oil contained in the refrigerant mixture guided from the first communication passage 16c to the region in which the bearing part 50 of the second space IS2 is arranged is more suppressed from being guided to the second communication passage 16d. This is because the lubricating oil is more likely to be separated from the refrigerant gas for a larger length in the rotation direction RD from the first communication passage 16c to the second communication passage 16d.

In the example illustrated in FIG. 6, although the first communication passage 16c is arranged at only one portion, which is at about 315 degrees away from a position at which the second communication passage 16d is arranged in the opposite direction of the rotation direction RD, various modifications are possible. For example, in the rotation direction RD, another position may be used as long as the position at which the first communication passage 16c is arranged and the position at which the second communication passage 16*d* is arranged are away from each other by 180 degrees or more.

The advantageous effects achieved by the scroll compressor 100 of the present embodiment described above will be described.

According to the scroll compressor 100 of the present embodiment, the rotary shaft 40 is rotated about the axis X by the motor 30, the orbiting scroll 22 to which the rotary shaft 40 is installed via the eccentric shaft 41 is revolved with respect to the fixed scroll 21, and the refrigerant gas is compressed and discharged. The inner space IS of the housing 10 for accommodating the motor 30 and the compressing part 20 is partitioned by the partition wall part 16 into the first space IS1 in which the motor 30 is arranged and the second space IS2 in which the bearing part 50 and the compressing part 20 are arranged.

The mixed refrigerant containing the lubricating oil and the refrigerant gas is guided by the first communication passage 16*c* in the partition wall part 16 from the first space IS1 to the region in which the bearing part 50 of the second space IS2 is arranged. The refrigerant gas contained in the mixed refrigerant guided to the region in which the bearing part 50 of the second space IS2 is arranged is guided by the second communication passage 16*d* to the compressing part 20. In such a way, according to the scroll compressor 100 of the present embodiment, it is possible to reliably guide the lubricating oil contained in a mixed refrigerant to the bearing part 50 and reliably guide the refrigerant gas contained in the mixed refrigerant to the compressing part 20.

According to the scroll compressor 100 of the present embodiment, the mixed refrigerant supplied to the first space IS1 from the intake port P1 can be passed through the through-holes 16*a*1, guided to the grooves 16*a*4, passed between the grooves 16*a*4 and the facing surface 16*b*B of the thrust plate 16*b*, and guided to the region in which the bearing part 50 of the second space IS2 is arranged.

According to the scroll compressor 100 of the present embodiment, the refrigerant gas contained in the mixed refrigerant supplied to the second space IS2 can be passed between the groove 16*a*5 and the facing surface 16*b*B of the thrust plate 16*b* and guided from the notch 16*b*1 to the compressing part 20.

According to the scroll compressor 100 of the present embodiment, the refrigerant gas is guided by the third communication passage 16*e* to the intake position P3 of the compressing part 20 of the second space IS2 from the first space IS1 without passing through the region in which the bearing part 50 is arranged. It is thus possible to directly guide the refrigerant gas to the intake position P3 of the compressing part 20 without causing a heat loss due to the refrigerant gas passing through the bearing part 50 and being heated.

According to the scroll compressor 100 of the present embodiment, the second communication passage 16*d* is formed on the opposite side to a position at which the notch 16*b*5 is formed with respect to the axis X. It is thus possible to suitably prevent the lubricating oil from being guided to the second communication passage 16*d*.

According to the scroll compressor 100 of the present embodiment, since the width W1 of the groove 16*a*5 is smaller than the width W3 of the notch 16*b*1, it is possible to suppress the lubricating oil contained in the mixed refrigerant from being guided from the notch 16*b*1 to the compressing part 20 compared to the case where the width of the groove 16*a*5 is the same as the width of the notch 16*b*1.

According to the scroll compressor 100 of the present embodiment, when the position at which the first communication passage 16*c* is arranged and the position at which the second communication passage 16*d* is arranged are away from each other by 180 degrees or more, the lubricating oil that has flown into the second space IS2 from the first communication passage 16*c* can be moved in the rotation direction RD by 180 degrees or more. Thus, compared to the case where the angle by which the position at which the first communication passage 16*c* is arranged and the position at which the second communication passage 16*d* is arranged are away from each other is less than 180 degrees in the rotation direction, the amount of lubricating oil that remains around the bearing part 50 can be increased.

The scroll compressor according to the present embodiment described above is understood as follows, for example.

A scroll compressor (100) according to the present disclosure includes: a compressing part (20) having a fixed scroll (21) and an orbiting scroll (22) engaged with the fixed scroll; a motor (30) configured to revolve the orbiting scroll with respect to the fixed scroll; a rotary shaft (40) configured to be rotated about an axis (X) by the motor and installed to the orbiting scroll via an eccentric shaft (41) arranged eccentrically from the axis; a bearing part (50) configured to support the rotary shaft; and a housing (10) formed in a cylindrical shape along the axis and having an inner space (IS) for accommodating the motor and the compressing part. The housing has a partition wall part (16) partitioning the inner space (IS) into a first space (IS1) and a second space (IS2), the motor being arranged in the first space, and the bearing part and the compressing part being arranged in the second space. The partition wall part has a first communication passage (16*c*) and a second communication passage (16*d*), the first communication passage being configured to guide a mixed refrigerant containing a lubricating oil and a refrigerant gas from the first space to a region of the second space, the bearing part being arranged in the region of the second space, and the second communication passage being configured to guide the refrigerant gas, which is contained in the mixed refrigerant guided to the region of the second space, to the compressing part.

According to the scroll compressor of the present disclosure, the rotary shaft is rotated about the axis by the motor, the orbiting scroll to which the rotary shaft is installed via the eccentric shaft is revolved with respect to the fixed scroll, and the refrigerant gas is compressed and discharged. The inner space of the housing for accommodating the motor and the compressing part is partitioned by the partition wall part into the first space in which the motor is arranged and the second space in which the bearing part and the compressing part is arranged.

The mixed refrigerant containing the lubricating oil and the refrigerant gas is guided by the first communication passage in the partition wall part from the first space to the region in which the bearing part of the second space is arranged. The refrigerant gas contained in the mixed refrigerant guided to the region in which the bearing part of the second space arranged is guided by the second communication passage to the compressing part. In such a way, according to the scroll compressor of the present disclosure, it is possible to reliably guide the lubricating oil contained in the mixed refrigerant to the bearing part and reliably guide the refrigerant gas contained in the mixed refrigerant to the compressing part.

The scroll compressor according to the present disclosure may be configured such that the partition wall part has a bearing support part (16*a*) partitioning the inner space into the first space and the second space, the bearing part being press-fitted into the bearing support part, and a plate-like thrust plate (16*b*) installed to the bearing support part and configured to support the orbiting scroll by a sliding surface (16*b*A) that is in contact with an end face of the orbiting scroll, and the first communication passage (16*c*) is formed of a through-hole (16*a*1) formed in the bearing support part, a first groove (16*a*4) formed in a face of the bearing support part on the thrust plate side and communicating with the through-hole and the second space, and a facing surface (16*b*B) of the thrust plate on the bearing support part side, the thrust plate being arranged so as to cover the first groove.

According to the scroll compressor of the present configuration, the mixed refrigerant supplied to the first space can be passed through the through-holes, guided to the first groove, passed between the first groove and the facing surface of the thrust plate, and guided to the region in which the bearing part of the second space is arranged.

The scroll compressor according to the present disclosure may be configured such that the second communication passage (16*d*) is formed of a second groove (16*a*5) formed in a face of the bearing support part on the thrust plate side, a facing surface of the thrust plate on the bearing support part side, the thrust plate being arranged so as to cover the second groove, and a notch formed in the thrust plate and configured to guide the refrigerant gas from the second groove to the compressing part.

According to the scroll compressor of the present configuration, the refrigerant gas contained in the mixed refrigerant supplied to the second space can be passed between the second groove and the facing surface of the thrust plate and guided from the notch to the compressing part.

The scroll compressor according to the present disclosure may be configured such that the partition wall part has a bearing support part partitioning the inner space into the first space and the second space, the bearing part being press-fitted into the bearing support part, and a plate-like thrust plate installed to the bearing support part and configured to support the orbiting scroll by a sliding surface that is in contact with an end face of the orbiting scroll, and the second communication passage is formed of a second groove formed in a face of the bearing support part on the thrust plate side, a facing surface on the bearing support part side of the thrust plate arranged so as to cover the second groove, and a notch formed in the thrust plate and configured to guide the refrigerant gas from the second groove to the compressing part.

According to the scroll compressor of the present configuration, the refrigerant gas contained in the mixed refrigerant supplied to the second space can be passed between the second groove and the facing surface of the thrust plate and guided from the notch to the compressing part.

The scroll compressor according to the present disclosure may be configured such that the partition wall part has a third communication passage (16*e*) configured to guide the refrigerant gas from the first space to the compressing part of the second space without causing the refrigerant gas to pass through the region in which the bearing part is arranged, and the third communication passage guides the refrigerant gas to an intake position (P3) in which an end of the fixed scroll or an end of the orbiting scroll is arranged.

According to the scroll compressor of the present configuration, the refrigerant gas is guided by the third communication passage to the intake position of the compressing part of the second space from the first space without passing through the region in which the bearing part is arranged. It is thus possible to directly guide the refrigerant gas to the intake position of the compressing part without causing a heat loss due to the refrigerant gas passing through the bearing part and being heated.

The scroll compressor according to the present disclosure may be configured such that, in the thrust plate, an oil returning part (16*b*5) configured to return the lubricating oil that remains below the housing from the sliding surface side to the facing surface side is formed, and the second communication passage is formed on the opposite side, with respect to the axis, to a position at which the oil returning part is formed.

According to the scroll compressor of the present configuration, the second communication passage is formed on the opposite side to a position at which the oil returning part is formed with respect to the axis. It is thus possible to suitably prevent the lubricating oil from being guided to the second communication passage.

The scroll compressor according to the present disclosure may be configured such that, in a rotation direction of the rotary shaft, the width of the second groove is smaller than the width of the notch.

According to the scroll compressor of the present configuration, since the width of the second groove is smaller than the width of the notch, it is possible to suppress the lubricating oil contained in the mixed refrigerant from being guided from the notch to the compressing part compared to the case where the width of the second groove is the same as the width of the notch.

The scroll compressor according to the present disclosure may be configured such that, in a rotation direction of the rotary shaft, a position at which the first communication passage is arranged and a position at which the second communication passage is arranged are away from each other by 180 degrees or more.

According to the scroll compressor of the present configuration, since the position at which the first communication passage is arranged and the position at which the second communication passage is arranged are away from each other by 180 degrees or more, the lubricating oil that has flown into the second space from the first communication passage can be moved in the rotation direction by 180 degrees or more. Thus, compared to the case where the angle by which the position at which the first communication passage is arranged and the position at which the second communication passage is arranged is away from each other is less than 180 degrees in the rotation direction, the amount of lubricating oil that remains around the bearing part can be increased.

REFERENCE SIGNS LIST

10 housing
11 first housing
12 second housing
13 third housing
14 bolt
15 leg
16 partition wall part
16*a* bearing support part
16*a*1, 16*a*2, 16*a*3 through-hole
16*a*4, 16*a*5 groove
16*b* thrust plate
16*b*1, 16*b*2, 16*b*3, 16*b*5 notch
16*b*A sliding surface
16*b*B facing surface
16*c* first communication passage
16*d* second communication passage

16*e* third communication passage
20 compressing part
21 fixed scroll
22 orbiting scroll
22*a* end face
22*b* bearing part
30 motor
40 rotary shaft
41 eccentric shaft
50, 60 bearing part
70 balance weight
80 inverter
100, 100A scroll compressor
IS inner space
IS1 first space
IS2 second space
P1 intake port
P3 intake position
RD rotation direction
VD vertical direction
X axis

The invention claimed is:

1. A scroll compressor comprising:

a compressing part having a fixed scroll and an orbiting scroll engaged with the fixed scroll;

a motor configured to revolve the orbiting scroll with respect to the fixed scroll;

a rotary shaft configured to be rotated about an axis by the motor and installed to the orbiting scroll via an eccentric shaft arranged eccentrically from the axis;

a bearing part configured to support the rotary shaft; and a housing formed in a cylindrical shape along the axis and having an inner space for accommodating the motor and the compressing part, wherein the housing has a partition wall part partitioning the inner space into a first space and a second space, the motor being arranged in the first space, and the bearing part and the compressing part being arranged in the second space, and wherein the partition wall part has a first communication passage and a second communication passage, the first communication passage being configured to guide a mixed refrigerant containing a lubricating oil and a refrigerant gas from the first space to a region of the second space, the bearing part being arranged in the region of the second space, and the second communication passage being configured to guide the refrigerant gas, which is contained in the mixed refrigerant guided to the region of the second space, to the compressing part.

2. The scroll compressor according to claim 1, wherein the partition wall part has a bearing support part partitioning the inner space into the first space and the second space, the bearing part being press-fitted into the bearing support part, and a plate-like thrust plate installed to the bearing support part and configured to support the orbiting scroll by a sliding surface that is in contact with an end face of the orbiting scroll, and wherein the first communication passage is formed of a through-hole formed in the bearing support part, a first groove formed in a face of the bearing support part on the thrust plate side and communicating with the through-hole and the second space, and a facing surface of the thrust plate on the bearing support part side, the thrust plate being arranged so as to cover the first groove.

3. The scroll compressor according to claim 2, wherein the second communication passage is formed of a second groove formed in a face of the bearing support part on the thrust plate side, a facing surface of the thrust plate on the bearing support part side, the thrust plate being arranged so as to cover the second groove, and a notch formed in the thrust plate and configured to guide the refrigerant gas from the second groove to the compressing part.

4. The scroll compressor according to claim 3, wherein, in the thrust plate, an oil returning part configured to return the lubricating oil that remains below the housing from a sliding surface side to a facing surface side is formed, and wherein the second communication passage is formed on the opposite side, with respect to the axis, to a position at which the oil returning part is formed.

5. The scroll compressor according to claim 3, wherein in a rotation direction of the rotary shaft, a width of an inlet region of the second groove is smaller than a width of the notch.

6. The scroll compressor according to claim 1, wherein the partition wall part has a bearing support part partitioning the inner space into the first space and the second space, the bearing part being press-fitted into the bearing support part, and a plate-like thrust plate installed to the bearing support part and configured to support the orbiting scroll by a sliding surface that is in contact with an end face of the orbiting scroll, and wherein the second communication passage is formed of a second groove formed in a face of the bearing support part on the thrust plate side, a facing surface of the thrust plate on the bearing support part side, the thrust plate being arranged so as to cover the second groove, and a notch formed in the thrust plate and configured to guide the refrigerant gas from the second groove to the compressing part.

7. The scroll compressor according to claim 1, wherein the partition wall part has a third communication passage configured to guide the refrigerant gas from the first space to the compressing part of the second space without causing the refrigerant gas to pass through the region in which the bearing part is arranged, and wherein the third communication passage guides the refrigerant gas to an intake position in which an end of the fixed scroll or an end of the orbiting scroll is arranged.

8. The scroll compressor according to claim 1, wherein in a rotation direction of the rotary shaft, a position at which the first communication passage is arranged and a position at which the second communication passage is arranged are away from each other by 180 degrees or more.

* * * * *